US006157121A

United States Patent [19]

Ragland, Jr. et al.

[11] Patent Number: 6,157,121

[45] Date of Patent: Dec. 5, 2000

[54] COLOR PICTURE TUBE HAVING METAL STRANDS SPACED FROM THE INSULATOR LAYERS

[75] Inventors: Frank Rowland Ragland, Jr.; Walter David Masterton, both of Lancaster, Pa.

[73] Assignee: Thomson Licensing S.A., Boulogne Cedex, France

[21] Appl. No.: 09/170,885

[22] Filed: Oct. 13, 1998

[51] Int. Cl.[7] ..... H01J 29/80

[52] U.S. Cl. ..... 313/403; 313/407; 313/408

[58] Field of Search ..... 313/402, 403, 313/407, 408, 409, 414, 479, 313, 420, 432, 439

[56] References Cited

U.S. PATENT DOCUMENTS

| | | | |
|---|---|---|---|
| 2,669,675 | 2/1954 | Lawrence | 315/22 |
| 5,111,106 | 5/1992 | Kaplan et al. | 313/403 |
| 5,625,251 | 4/1997 | Nosker et al. | 313/403 |
| 5,646,478 | 7/1997 | Nosker et al. | 313/402 |
| 5,647,653 | 7/1997 | Cherukuri | 313/402 |

FOREIGN PATENT DOCUMENTS

WO97/05643 2/1997 WIPO .

*Primary Examiner*—Michael H. Day
*Assistant Examiner*—Mariceli Santiago
*Attorney, Agent, or Firm*—Joseph S. Tripoli; Dennis H. Irlbeck

[57] ABSTRACT

A color picture tube comprises an evacuated envelope having an electron gun therein for generating at least one electron beam, a faceplate panel having a luminescent screen with phosphor lines on an interior surface thereof, and a tension focus mask. The mask has spaced apart first metal strands which are adjacent to an effective picture area of the screen and define a plurality of slots substantially parallel to the phosphor lines. Each of the first metal strands across the effective picture area have a substantially continuous insulator layer on a screen-facing side thereof. The mask also includes a plurality of second metal strands oriented substantially perpendicular to the first metal strands. The second metal strands are spaced from the insulator layer when the tube is not energized and are in contact with the insulator layer when the tube is energized.

2 Claims, 2 Drawing Sheets

COLOR PICTURE TUBE HAVING METAL STRANDS SPACED FROM THE INSULATOR LAYERS

This invention relates to color picture tubes having tension masks, and particularly to a color picture tube having a tension focus mask.

BACKGROUND OF THE INVENTION

A color picture tube includes an electron gun for generating and directing three electron beams to a screen of the tube. The screen is located on the inner surface of a faceplate of the tube and comprises an array of elements of three different color emitting phosphors. A color selection electrode, which may be either a shadow mask or a focus mask, is interposed between the gun and the screen, to permit each electron beam to strike only the phosphor elements associated with that beam. A shadow mask is a thin sheet of metal, such as steel, that is contoured to somewhat parallel the inner surface of the tube faceplate. A focus mask comprises dual sets of conductive lines that are perpendicular to each other and usually separated by an insulative layer.

U.S. Pat. No. 5,646,478, issued to R. W. Nosker et al. on Jul. 8, 1997, and U.S. Pat. No. 5,647,653, issued to S. C. Cherukuri on Jul. 15, 1997, disclose focus mask tubes wherein the masks are formed by two perpendicular sets of metal strands. One set of strands is under tension and includes an insulator coating that is applied in two layers of different materials. The second or top layer is used to attach the second set of strands to the first set, by sintering. U.S. Pat. No. 5,629,051, issued to E. S. Poliniak on May 13, 1997, discloses a method of applying the insulator coating to the first set of strands.

A few problems exist with the technique of attaching the two sets of strands. For example, the second insulator layer can chip, thereby leaving particles within a tube. When subjected to shock, the strands may shift relative to each other, and, because of their mutual attachment, the strands may be unable to return to their original positions. The present invention provides a mask structure that eliminates such problems.

SUMMARY OF THE INVENTION

The present invention provides a color picture tube comprising an evacuated envelope having an electron gun therein for generating at least one electron beam, a faceplate panel having a luminescent screen with phosphor lines on an interior surface thereof, and a tension focus mask. The mask has spaced apart first metal strands which are adjacent to an effective picture area of the screen and define a plurality of slots substantially parallel to the phosphor lines. Each of the first metal strands across the effective picture area has a substantially continuous insulator layer on a screen-facing side thereof. The mask also includes a plurality of second metal strands oriented substantially perpendicular to the first metal strands. The second metal strands are spaced from the insulator layer when the tube is not energized and are in contact with the insulator layer when the tube is energized.

DETAILED DESCRIPTION OF THE PREFERRED EMBODIMENTS

Figure 1:
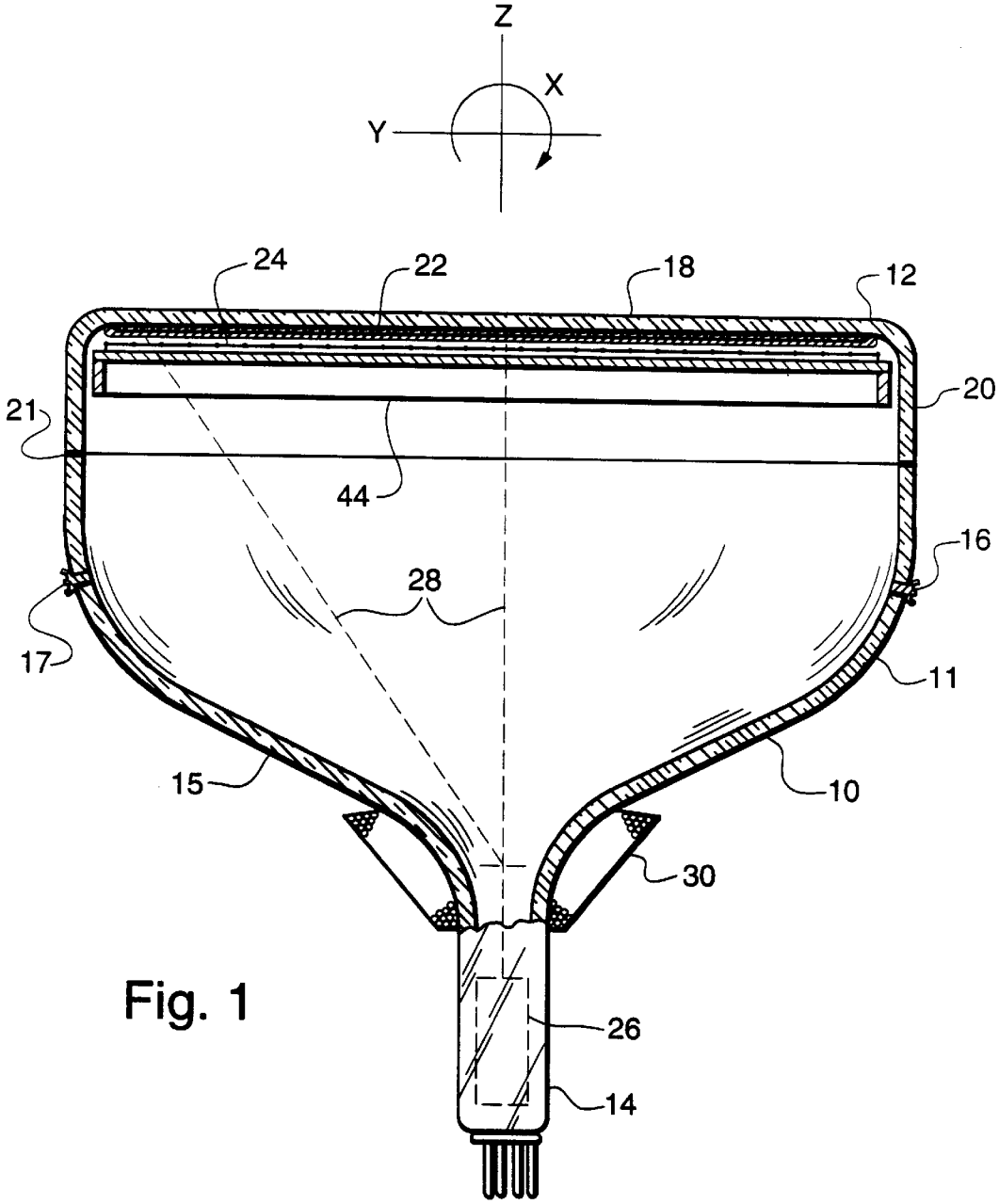
FIG. 1 is a side view, partly in axial secti , of a color picture tube embodying the invention.

FIG. 1 shows a color picture tube 10 having a glass envelope 11 comprising a rectangular faceplate panel 12 and a tubular neck 14 connected by a rectangular funnel 15. The funnel 15 has a main internal conductive coating (not shown) that extends from a first anode button 16 to the neck 14. A second anode button 17, located opposite the first anode button, is in contact with a secondary internal conductive coating (not shown) on the funnel 15. The panel 12 comprises a substantially flat viewing faceplate 18 and a peripheral flange or sidewall 20, which is sealed to the funnel 15 by a glass frit 21. A three-color phosphor screen 22 is carried by the inner surface of the faceplate 18. The screen 22 is a line screen with the phosphor lines arranged in triads, each triad including a phosphor line of each of three colors. The phosphor lines approximately parallel a minor axis Y of the tube. A tension focus mask 24 is removably mounted in predetermined spaced relation to the screen 22. An electron gun 26, shown schematically by dashed lines in FIG. 1, is centrally mounted within the neck 14 to generate and direct three inline electron beams 28, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

Figure 2:
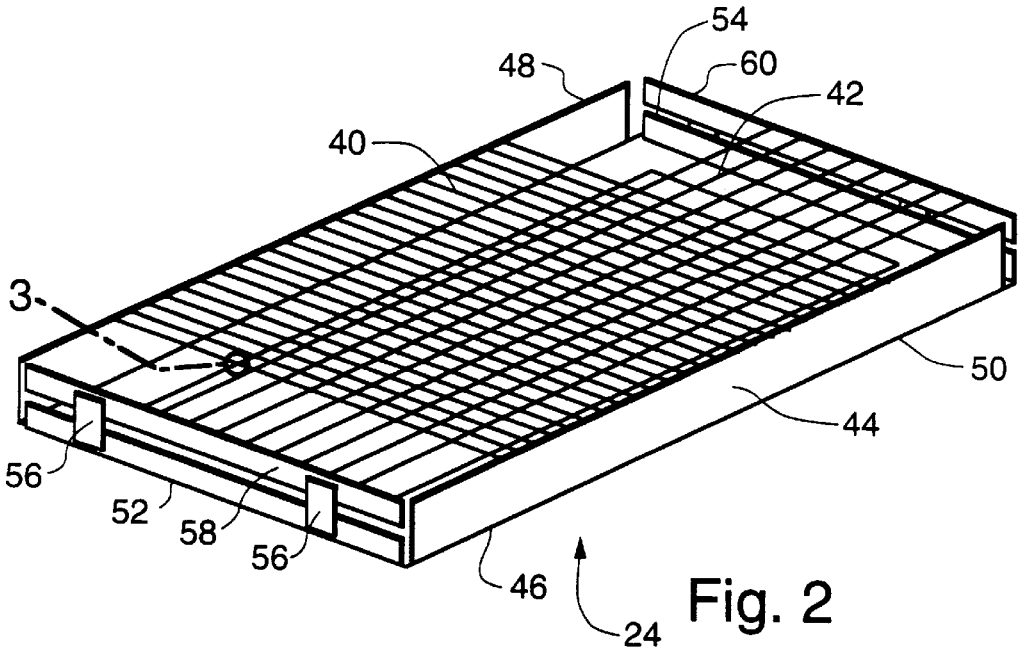
FIG. 2 is a perspective view of a tensioned shadow mask-frame assembly in the tube of FIG. 1.

The tension focus mask 24, shown in FIG. 2, is made, preferably, from a thin rectangular sheet of about 0.05 mm (2 mil) thick low carbon steel. The sheet is etched into a plurality of elongated first metal strands 40, each having a transverse dimension, or width, of about 0.3 mm (12 mils) separated by substantially equally spaced slots, each having a width of about 0.55 mm (21.5 mils), that approximately parallel the minor axis Y of the tube. In a color tube having a diagonal dimension of 68 cm (27V), there are about 600 of the first metal strands 40. One surface of each strand 40 is coated with an insulator layer 41. Preferably, the layer 41 is continuous along the length of each strand 40.

A plurality of second metal strands 42, each having a diameter of about 0.025 mm (1 mil), are disposed substantially perpendicular to the first metal strands 40. The preferred material for the second metal strands is Invar (TM Reg. #63,970) wire. The vertical spacing, or vertical pitch, between adjacent second strands 42 is about 0.41 mm (16 mils). The relatively thin second metal strands 42 cooperate with the first metal strands 40, to provide focusing of the electron beams 28. The focus mask, as described herein, provides a mask transmission, at the center of the screen, of about 60%. For a conventional shadow mask, the transmission is of 18% to 20%. When the tube is energized, the voltage applied to the first metal strands 40 differs from the voltage applied to the second metal strands 42 by less than 1 kV, at an anode voltage of about 30 kV. The voltages are applied to the two anode buttons 16 and 17 and are conducted to the strands 40 and 42, respectively, by the main and secondary internal coatings on the funnel 15.

A frame 44, for supporting the tensioned focus mask 24, is shown in FIG. 2. The frame 44 includes a large rectangular section 46 that has two long sides 48 and 50, substantially paralleling the major axis X of the tube, and two short sides 52 and 54, paralleling the minor axis Y of the tube. The long sides 48 and 50 have more than twice the height, in the longitudinal axis Z direction, of the height of the short sides 52 and 54. The plurality of first metal strands 40 extend between the long sides 48 and 50 of the frame section 46. Connected to the shorts sides 52 and 54, by springs 56, are two second strand support sections 58 and 60, respectively. The two sections 58 and 60 are separated from and parallel to the short sides 52 and 54. The plurality of second metal strands 42 are connected to and extend between the two sections 58 and 60, with the springs 56 applying a slight tension on the strands 42. The second metal strands 42 must be electrically isolated from the first metal strands 40. There are several ways to accomplish this isolation, such as by forming the springs 56 or the sections 58 and 60 from non-conductive materials, or by forming these components from laminated materials, with one of the laminated materials being non-conductive.

Figure 3:
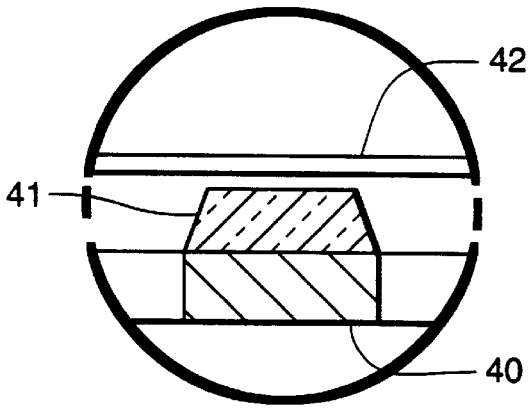
FIG. 3 is an isolated view of a vertical strand in cross-section, and a horizontal strand taken at circle 3 in FIG. 2.
Figure 4:
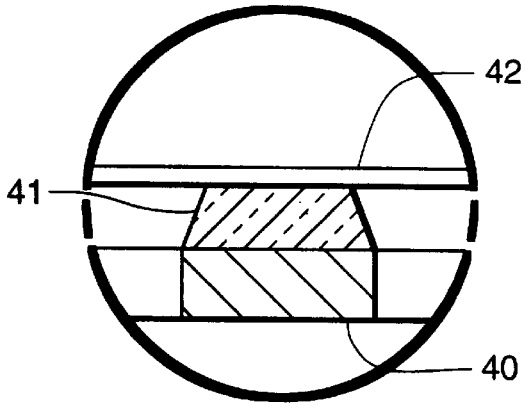
FIG. 4 is the same view as FIG. 3 during activation of the tube.

Unlike the tension focus masks of the prior patents cited above, the second metal strands 42 are not permanently attached to the first metal strands 40 by an insulator layer; instead they are separated and spaced from the insulator layers 41 on the first metal strands 40, as shown in FIG. 3. However, as shown in FIG. 4, when the tube 10 is energized, e.g., with a difference of a few hundred volts between the first and second metal strands, 40 and 42, an electrostatic attraction occurs between the two sets of strands that brings the second metal strand 42 into contact with the insulator layers 41 on the first metal strands 40.

Preferably, the insulator layers 41 have a thickness in the range of 0.05 to 0.09 mm (2 to 3.6 mils) across the strands 40. The preferred material for the insulator layers 41 is a lead-zinc-borosilicate devitrified solder glass that melts in the range of 400° to 450° C. and is commercially available, as SCC-11, from a number of glass suppliers, including SEM20 COM, Toledo, Ohio, and Corning Glass, Corning, N.Y. The set of metal strands 42 preferably are spaced about 0.025 to 0.05 mm (1 to 2 mils) from the insulative layers 41 on the strands 40, when the tube 10 is inactive.

An advantage of the above-described mask construction is that the strands are free to return to their nominal positions, when their electrical potentials are removed. Therefore, the positions of the strands are unaffected by mechanical shocks that could otherwise shift them if they were permanently attached together.

What is claimed is:

1. A color picture tube comprising an evacuated envelope having an electron gun therein for generating at least one electron beam, a faceplate panel having a luminescent screen with phosphor lines on an interior surface thereof, and a tension focus mask having spaced apart first metal strands which are adjacent to an effective picture area of said screen and define a plurality of slots substantially parallel to said phosphor lines, each of said first metal strands across said effective picture area having a substantially continuous insulator layer on a screen-facing side thereof, and a plurality of second metal strands oriented substantially perpendicular to said first metal strands, said second metal strands being spaced from said insulator layers when said tube is not energized and being in contact with said insulator layer when said tube is energized.

2. A color picture tube comprising an evacuated envelope having an electron gun therein for generating at least one electron beam, a faceplate panel having a luminescent screen with phosphor lines on an interior surface thereof, and a tension focus mask having a spaced apart first metal strands which are adjacent to an effective picture area of said screen and define a plurality of slots substantially parallel to said phosphor lines, each of said first metal strands across said effective picture area having a substantially continuous insulator layer on a screen-facing side thereof, and a plurality of second metal strands oriented substantially perpendicular to said first metal strands, said second metal strands being spaced from said insulator layers a distance that allows contact of said second metal strands with said insulator layers through electrostatic attraction when said tube is energized.

* * * * *